US009315964B2

(12) United States Patent
Jonninen

(10) Patent No.: US 9,315,964 B2
(45) Date of Patent: Apr. 19, 2016

(54) METHOD FOR EVACUATING TRANSFER AIR FROM A MIXTURE OF PRESSURIZED AIR AND BINDING AGENT

(75) Inventor: Markku Jonninen, Lohilahti (FI)

(73) Assignee: ALLU GROUP OY, Orimattila (FI)

( * ) Notice: Subject to any disclaimer, the term of this patent is extended or adjusted under 35 U.S.C. 154(b) by 144 days.

(21) Appl. No.: 14/128,445

(22) PCT Filed: Jun. 21, 2012

(86) PCT No.: PCT/FI2012/050655
§ 371 (c)(1),
(2), (4) Date: Mar. 26, 2014

(87) PCT Pub. No.: WO2013/001160
PCT Pub. Date: Jan. 3, 2013

(65) Prior Publication Data

US 2014/0199125 A1 Jul. 17, 2014

(30) Foreign Application Priority Data

Jun. 28, 2011 (FI) ..... 20115676

(51) Int. Cl.

| | |
|---|---|
| ***E02D 3/12*** | (2006.01) |
| ***E02D 5/46*** | (2006.01) |
| ***E21B 33/13*** | (2006.01) |
| ***E02D 7/24*** | (2006.01) |

(52) U.S. Cl.
CPC .. *E02D 3/12* (2013.01); *E02D 5/46* (2013.01); *E02D 7/24* (2013.01); *E21B 33/13* (2013.01)

(58) Field of Classification Search
CPC ..... E02D 3/12; E02D 7/24; E02D 3/126; E02D 5/46; B09B 3/0041; E21B 33/13; E21B 41/0057
USPC ..... 405/232, 233, 236, 240, 248, 269, 405/302.4
See application file for complete search history.

(56) References Cited

U.S. PATENT DOCUMENTS

| | | | | |
|---|---|---|---|---|
| 3,875,751 A * | 4/1975 | Paus | 405/263 |
| 4,844,807 A * | 7/1989 | Manchak, Jr. | 210/682 |
| 5,484,233 A * | 1/1996 | Kunito | 405/240 |
| 5,814,147 A * | 9/1998 | Tallard | 405/264 |

(Continued)

FOREIGN PATENT DOCUMENTS

| | | |
|---|---|---|
| DE | 297 16 673 U1 | 1/1998 |
| DE | 103 10 727 A1 | 10/2004 |
| EP | 1069245 A1 | 1/2001 |

(Continued)

OTHER PUBLICATIONS

International Search Report for International Patent Application No. PCT/FI2012/050655, mailed Oct. 4, 2012, 6 pages.

(Continued)

*Primary Examiner* — Benjamin Fiorello
*Assistant Examiner* — Carib Oquendo
(74) *Attorney, Agent, or Firm* — Sterne, Kessler, Goldstein & Fox, P.L.L.C.

(57) ABSTRACT

A method for evacuating transfer air contained in a binding agent from a mixture of pressurized air and binding agent uses an apparatus comprising means for producing pressurized air, a binding agent container, a supply pipe for the mixture of pressurized air and binding agent, and an apparatus for mixing the binding agent into the earth mass.

5 Claims, 7 Drawing Sheets

(56) References Cited

U.S. PATENT DOCUMENTS

2007/0189859 A1* 8/2007 Gunther ..... 405/233
2013/0011207 A1* 1/2013 Schneider ..... 405/269

FOREIGN PATENT DOCUMENTS

JP 60-112919 A 6/1985
JP 61-057714 A 3/1986

OTHER PUBLICATIONS

Finnish Search Report for Patent Application No. 20115676 dated May 22, 2012, 1 page.
Extended European Search Report for European Patent Application No. 12 803 863.5, mailed Jun. 18, 2015, 4 pages.

* cited by examiner

METHOD FOR EVACUATING TRANSFER AIR FROM A MIXTURE OF PRESSURIZED AIR AND BINDING AGENT

BACKGROUND OF THE INVENTION

The invention relates to a method for evacuating transfer air contained in a binding agent from a mixture of pressurized air and binding agent when stabilizing earth masses by adding binding agent, in which method is used an apparatus comprising means for producing pressurized air, a binding agent container, a supply pipe for the mixture of pressurized air and binding agent, and an apparatus for mixing the binding agent into the earth mass. In the method, the pressurized air used for transferring the binding agent is evacuated through a separate discharge pipe by means of the following measures before the pressurized air in conveyed into the earth mass: 1) the binding agent is conveyed into a storage space with a binding agent discharge opening into the ground, and 2) the pressure level in the apparatus is adjusted to be such that the pressure in the storage space exceeds the counter-pressure caused by the ground at the discharge opening, whereupon the binding agent discharges from the storage space via the discharge opening, out into the ground, and at least a part of the air discharges controllably from the upper part of the storage space into the discharge pipe.

Commonly used stabilization methods can be divided into two basic methods. In Japan a widely used method is when a binding agent, mainly cement, mixed in water, is supplied into the ground. The binding agent is mixed in large units and delivered to the worksite in a form ready to be supplied into the ground. This system makes the dosing of the binding agent highly accurate because the supply of liquid can be cut off and started without the slowness of an air supply. The supply units are also so-called non-pressurized containers which contain a pump unit and thus the technology is simple. The problem with this wet method is its susceptibility to external malfunctions, that is, the supplies of binding agent must be accurately timed and there may not be very serious malfunctions in the mixing and feeding devices themselves in order for the hardening binding agent not to clog inside the devices.

The other basic method is a method developed in the Nordic Countries, wherein the binding agent is delivered to the worksite in powder form and is transferred in pressurized form into storage containers, and from there further in pressurized form into supply containers. The pressure in the storage and transfer containers is usually 1-2 bars and in the supply containers 6-8 bars. In this method, the binding agent is supplied and dosed into the pressurized air in dry form, the advantage then being that the logistics of the binding agent deliveries are not very strict, as long as there is always binding agent in the storage container at the worksite. The binding agent also remains usable for a long time in powder form and thus sudden work stoppages will not cause problems to the feeding apparatuses.

In both methods, the binding agent is supplied and mixed into the ground by means of a mixing head fixed to the end of a rotating pipe. There may be several of these rotating pipes connected into a group, whereby several pillars can be made in one work stage. The rotating pipe may be round or a polygon, usually square, inside which the binding agent is conveyed into the ground.

Since the entire pipe with the mixing head at its lower end rotates, when going deeper, a major part of the rotating torque is required for other than rotating the actual mixing head and for mixing the soil. The rotating torque is usually transferred to the pipe by means of a transmission chain or gear transmission fixed to its upper end.

In all methods, the actual pillar stabilization unit is a large and heavy device, the moving of which from one worksite to another is slow and expensive. Due to its massiveness, the device itself is expensive in terms of investment costs.

Advantages of the wet method are an accurate supply of binding agent and minor interference with the surrounding soil. A disadvantage is the inapplicability of the method to sites where the natural water content of the soil to be treated is high (e.g. most clays in Scandinavia). At these worksites, the quality of the pillar is impaired by the fact that the premixed mixture of binding agent and water does not mix well in the ground, but tends to penetrate to the surface, thus causing quality variations in the pillar. As disadvantages may also be considered the distance of the production site of the binding agent from the worksite and the logistic problems caused by this and the limited time between the production of the binding agent and feeding it into the ground, which does not allow for interference or stoppages in the process.

Advantages of the dry method are a greater independence of the supplier of the binding agent and the storability of the binding agent at the worksite, which allows for more flexible working. The disadvantages include the conveyance of pressurized air into the ground, where it interferes with the surrounding soil and impairs the quality of the pillar, and due to the different layers of the soil, a part of the binding agent is discharged from the pillar through pressure discharge channels. Dusting is also sometimes a problem, although with appropriate work methods it can be almost completely eliminated. Interference with the surrounding soil affects the bearing capacity of the pillar and the amount of binding agent in the pillar may vary greatly over a short distance depending on the porosity of the soil.

BRIEF SUMMARY OF THE INVENTION

The aim of the invention is to provide a method by which the disadvantages of the above-mentioned known methods can be avoided or at least substantially reduced.

This aim can be achieved by the method according to the invention, the characteristics of which are disclosed in the accompanying claim 1. The dependent claims disclose preferred embodiments of the invention.

BRIEF DESCRIPTION OF THE DRAWINGS

The invention is illustrated in the following with reference to the accompanying drawings which describe a device according to one embodiment by means of which the method according to the invention can be implemented.

DETAILED DESCRIPTION OF EMBODIMENTS OF THE INVENTION

Figure 1:
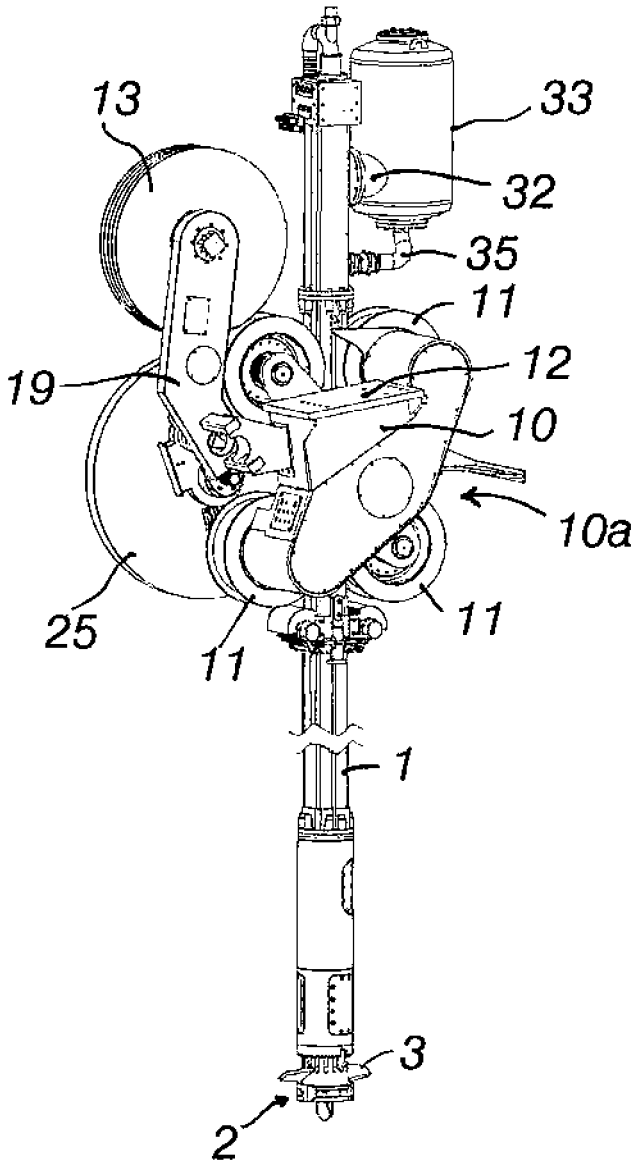
FIG. 1 shows a perspective view of a device for implementing the method according to the invention, which can be connected to the external devices shown in FIG. 2.
Figure 2:
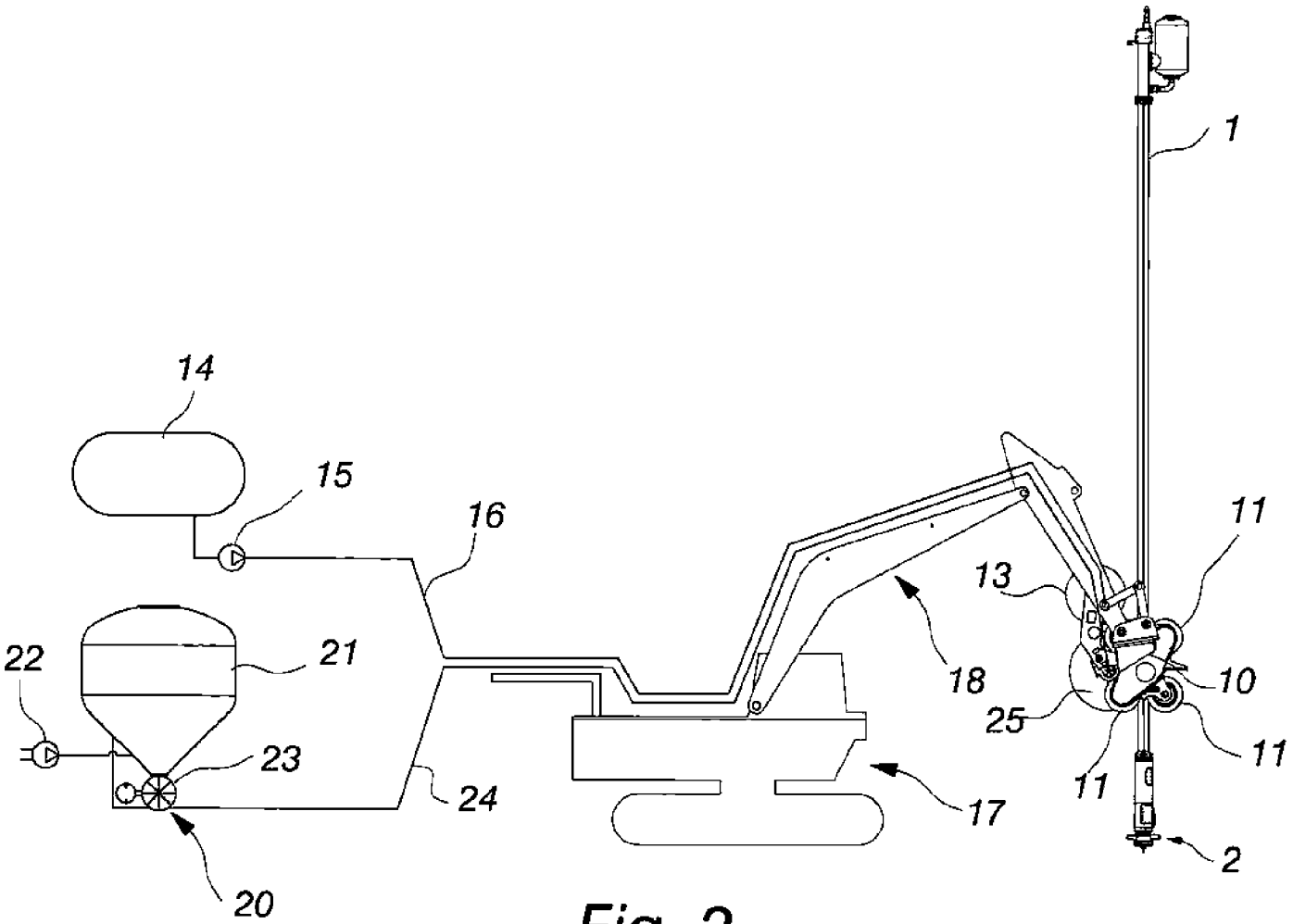
FIG. 2 shows the entire apparatus, including the device for implementing the method according to the invention and the external devices serving its use.
Figure 3:
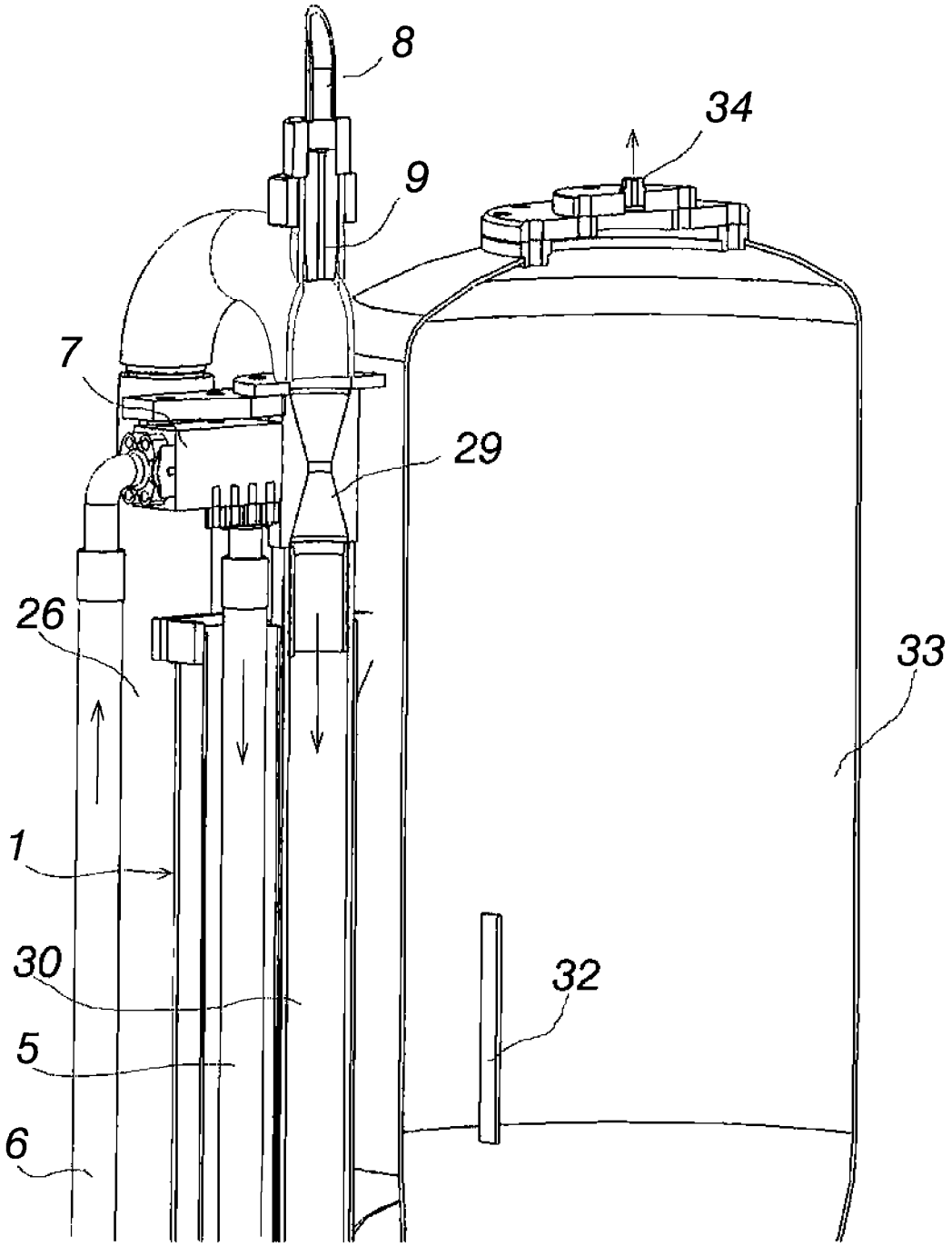
FIG. 3 shows the upper part of the device for implementing the method according to the invention in partial section.
Figure 4:
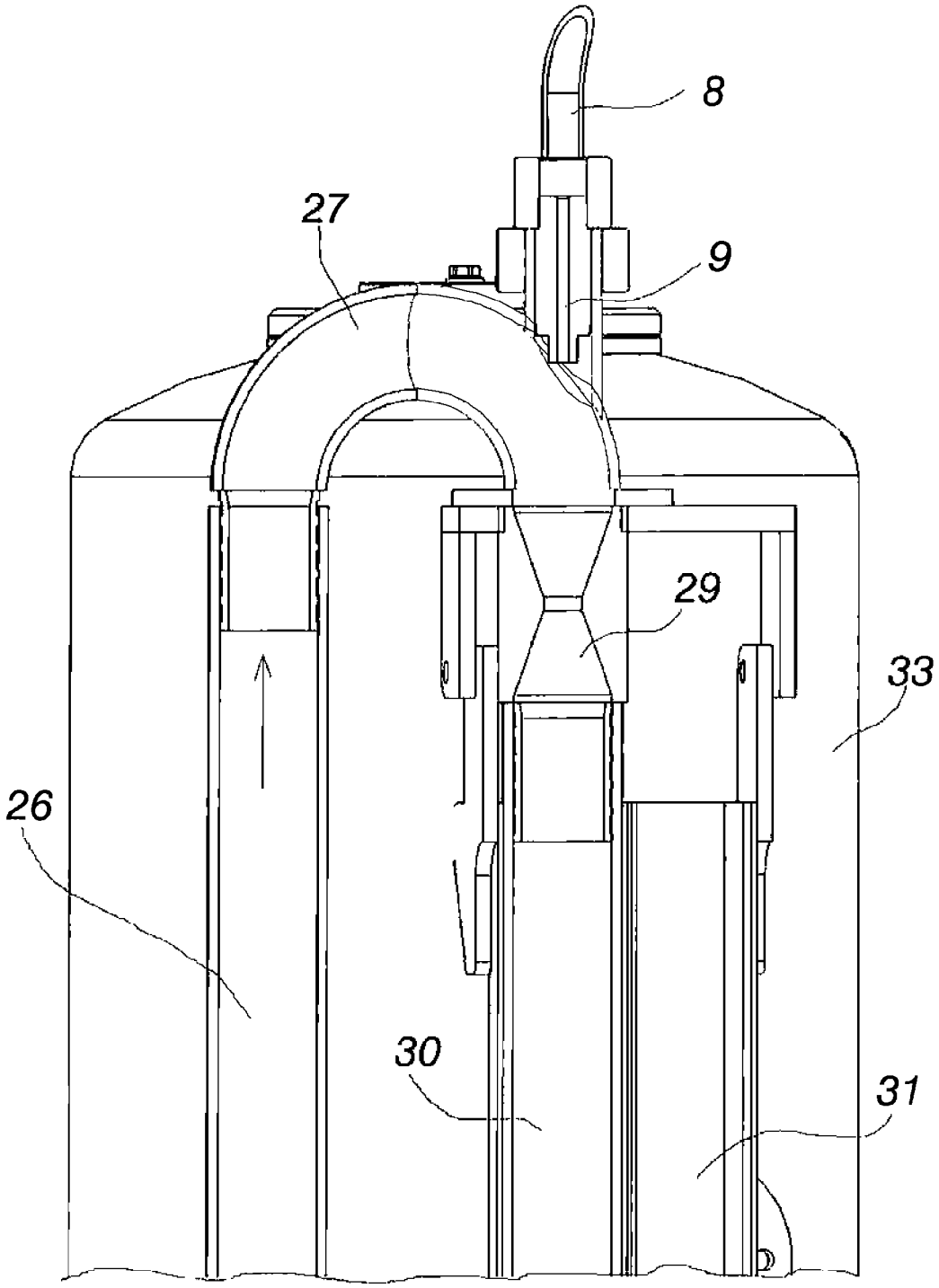
FIG. 4 shows the upper part of the device from a different sectional direction than FIG. 3.
Figure 5:
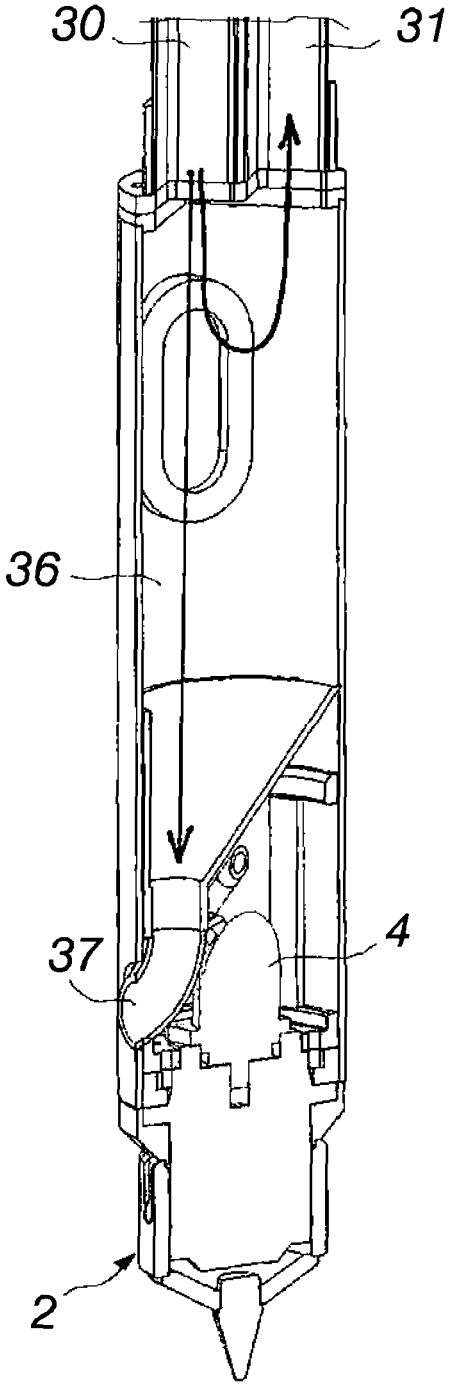
FIG. 5 shows the lower part of the device in partial section and without the mixing blades.
Figure 6:
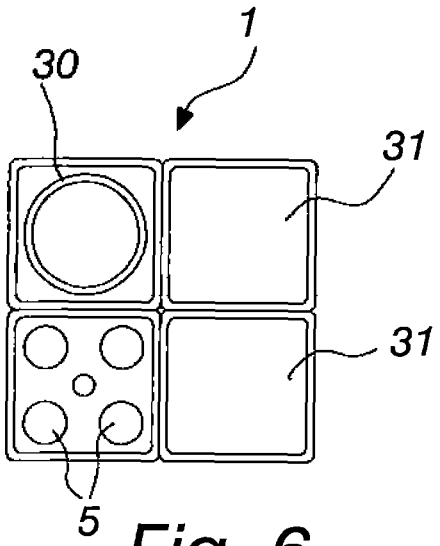
FIG. 6 shows a cross-section of the vertical boom 1 of the device.

The general structure of the device implementing the method according to the invention appears from FIG. 1. The device comprises a body 10 and a vertical boom 1 which are moved guided by four rotating flanged rolls 11. The rolls 11 are fitted with bearings on the body 10 and at least one roll is provided with a rotating motor which is inside the body housing. The rolls 11 are provided with a flexible coating, such as elastomer, rubber, or silicone, which at the same time form friction surfaces, and the rolls 11 are pressed in pairs against the vertical boom 1, whereby the vertical boom 1 can he moved in one direction or another with respect to the body 10.

The vertical boom 1 consists of four pipes in the part corresponding to its distance of movement, one of which forms the binding agent supply pipe 30 and two form supply air discharge pipes 31. The fourth pipe forms a channel for the hydraulic tubes 5 which are connected to a manifold 7 at the upper end of the vertical boom 1 and to the rotating motor 4 of the mixing head 2 at the lower end. The vertical boom 1 is thus non-rotating in use and only the mixing head 2 is rotated.

Figure 7:
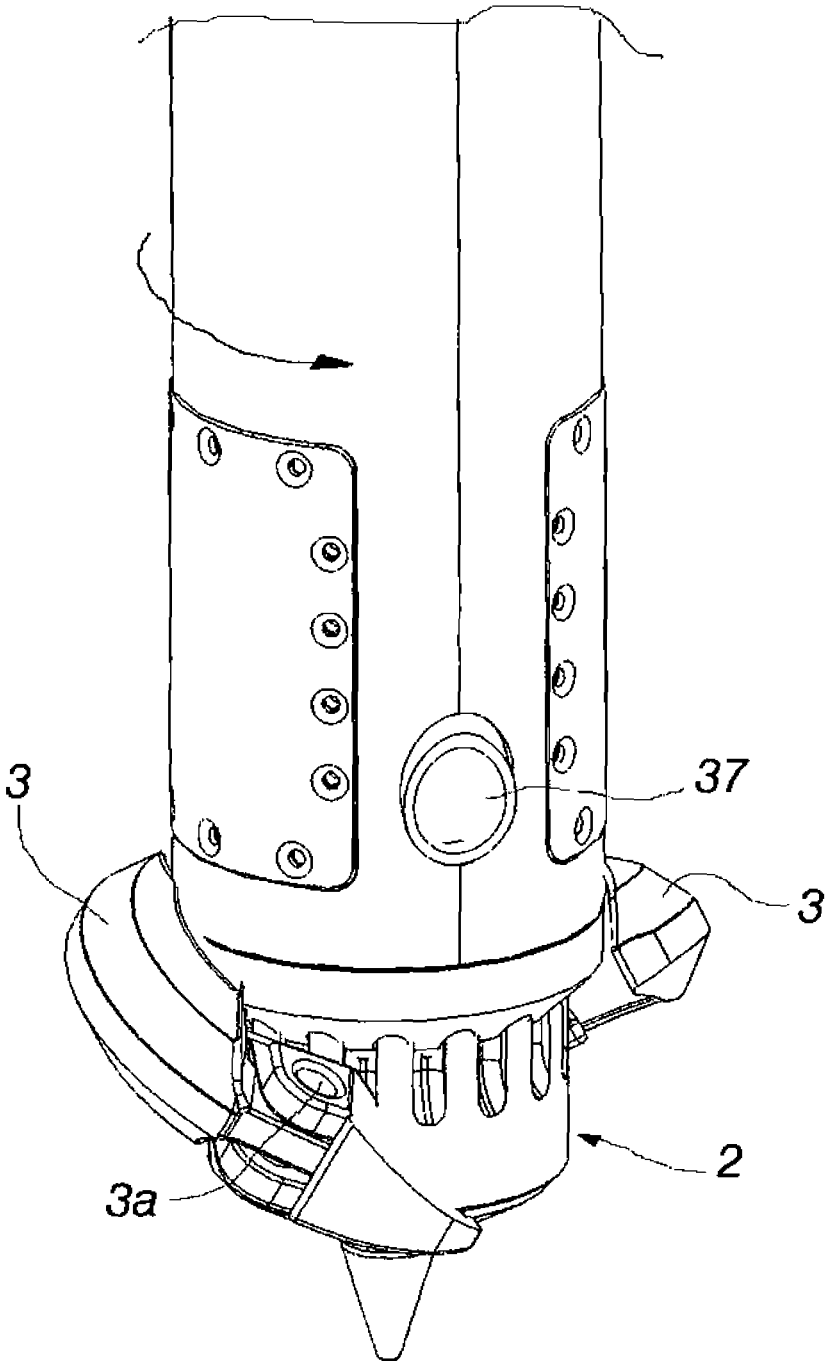
FIG. 7 shows the lower end of the device according to the invention with the mixing blades 3 turned inwards.
Figure 8:
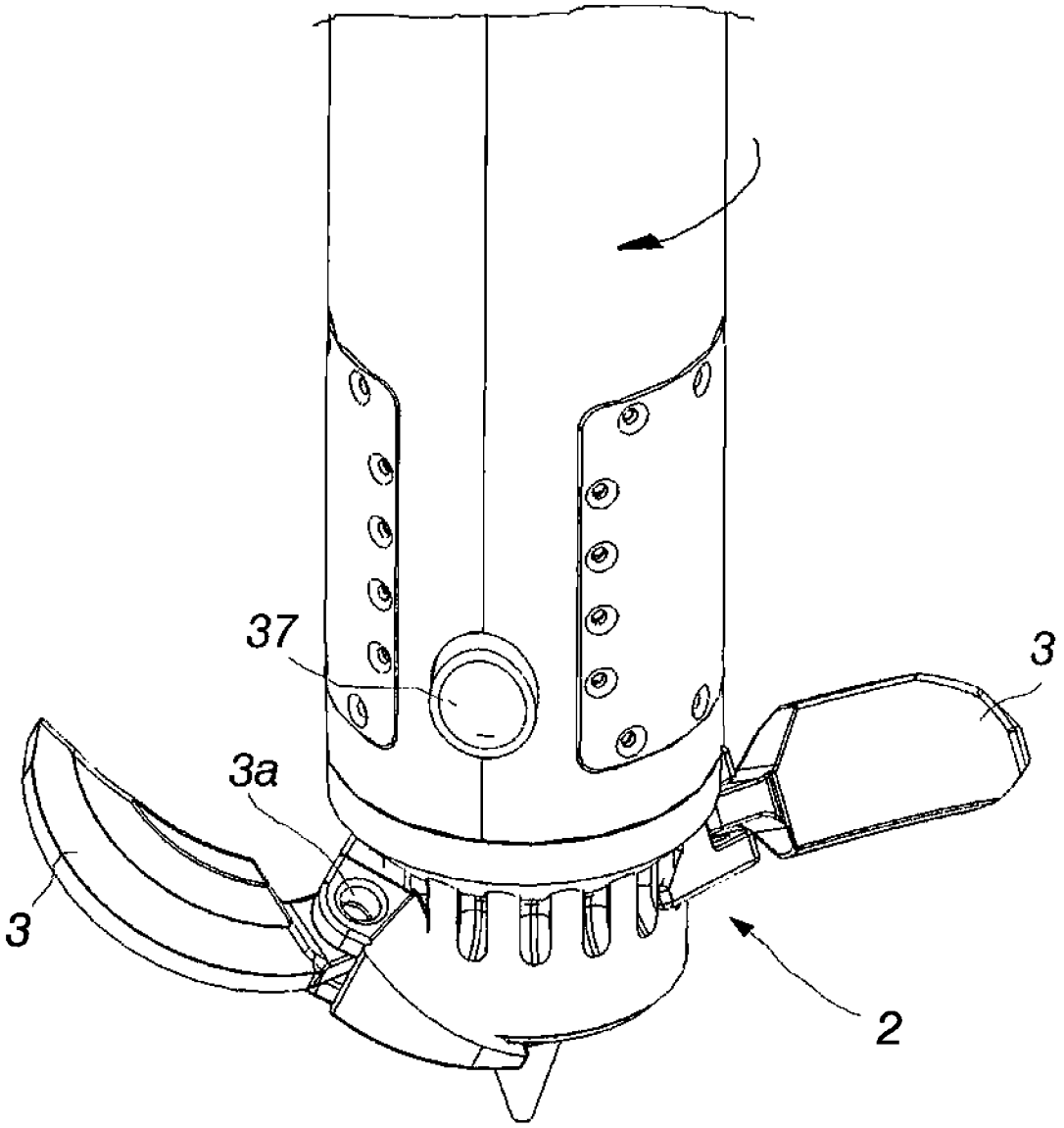
FIG. 8 shows the lower end of the device with the mixing blades 3 turned radially outwards.

The mixing head 2 comprises turning mixing blades 3 which, when rotated in one direction, turn inwards due to the effect of the resistance of the earth. The reversal links 3*a* are shown in FIGS. 7 and 8. The axial direction of the reversal links 3*a* is inclined with respect to the axis of rotation of the mixing head 2. The mixing blades 3 may be designed in such a way that in the inwards turned position they form a downwards pulling screw thread around the vertical boom. The vertical boom is then easy to push into the ground through the crust layer without unnecessarily breaking the crust layer, in which only remains a hole with a small diameter. Once the mixing blades 3 have been driven into the desired depth or against solid soil, the direction of rotation of the mixing head 2 is reversed, for example, from counter-clockwise to clockwise, whereupon the soil pressure opens the mixing blades 3 and the feeding and mixing of the binding agent and the lifting movement of the vertical boom 1 may begin.

To adjust the mixing cross-section, the turning angle of the mixing blades 3 can be arranged to be adjustable, for example, by means of adjusting pieces restricting turning, or the mixing blades 3 can be replaced by mixing blades of different length. By means of adjustable mixing blades 3, the device can rapidly be made to produce pillars with a desired diameter. For example, the currently most common pillars with diameters of 600, 700 or 800 mm can be made with one and the same quick-adjusting mixing blades. Pillars with diameters of 900, 1000, 1200 mm can be obtained by replacing the mixing blades. With the method according to the invention, the upper limit for the diameter of the pillar is determined by the quality of the soil and practical worksite factors and thus a pillar with a 2000 mm diameter is easily implemented. With turning mixing blades is in turn eliminated the problem caused by a large blade diameter of penetrating through the crust layer.

The body 10 comprises fixing means 12 for fixing the bucket loader 17 to the boom 18. The body 10 with the rolls 11 and the rotating motor of the rolls 11 can be designated as the transfer device of the vertical boom 1 which is denoted by reference numeral 10*a*. The fixing device 12 may be a standard adapter by means of which the transfer device 10*a* can be connected in place of the bucket loader's 17 bucket. The hydraulic motor 4 rotating the transfer device 10*a* of the vertical boom 1 and the mixing head 2 is driven by the bucket loader's 17 hydraulics.

To the body 10 is fixed a coil holder 19 comprising a coil 25 for the binding agent delivery hose 26 and a coil 13 for the hydraulic hoses, and the water hose 6 to which water is supplied from a tank 14 via a pump 15 and a hose 16.

The binding agent is supplied from the binding agent container 21 by means of pressurized air produced by a compressor 22. A dosing feeder 23 doses the binding agent into a delivery hose 24 which is connected via a lead-in in the centre shaft of the coil 25 to the hose 26 wound on the coil 25. The upper end of the hose 26 is connected via a flow elbow 27 to a Laval nozzle 29, which is in turn connected to the actual binding agent supply pipe 30, the lower end of which opens into a storage space 36 at the lower end of the vertical boom 1, in which there is a discharge opening 37 out into the ground. The transfer air contained in the binding agent is evacuated outside from the upper part of the storage space 36, through a discharge pipe 31. In the case shown, the air to be evacuated is further purified with a cyclone scrubber 33 to which the upper end of the discharge pipe 31 is connected via an opening 32. To the opening 32 is connected a flow director (not shown) for bringing the flow into a rotary motion. Air is discharged controllably from the opening 34 in the centre of the upper flange of the cyclone scrubber 33. In the rotary motion of the cyclone scrubber 33, the fine binding agent is separated and discharged by means of a pipe 35 connected to the lower end of the cyclone scrubber 33 back to the discharge pipe 31, where the discharge flow is washed with water jets (not shown). The washing sludge flows back into the storage space 36.

The water supply pipe 6 is connected to a manifold 7, from which water is supplied by means of a pipe 8 via a nozzle 9 to a Venturi-type nozzle, that is, a so-called Laval nozzle 29. The flow rate of the mixture of air, binding agent, and water is accelerated momentarily in the nozzle 29, whereupon the water disperses into a mist to which the powdery binding agent adheres, thus forming a sludge-like mass which is led to the storage space 36.

The pressure level in the apparatus is adjusted to be such that the pressure in the storage space 36 exceeds the counter-pressure caused by the soil in the discharge opening 37, whereby the binding agent discharges from the storage space 36 through the discharge opening 37 into the ground and as large a proportion of the air as possible is evacuated controllably from the upper part of the storage space 36 into the dis-charge pipe 31. The direction of flow of the supply air is, therefore, reversed from the supply flow directed downwards in the upper part of the storage space 36 in a tight curve to an upwards directed discharge flow, and the upwards directed flow rate is decreased to less than half of the downwards directed flow rate by using the cross-sectional area of the discharge pipe 31, which is at least twice as large as the cross-sectional area of the supply pipe 30.

The separation of the binding agent and water from the air can be intensified by means of centrifugal force in such a way that the direction of flow of the supply air is set into rotary motion with respect to the vertical axis in the storage space before reversing the flow upwards.

The amount of evacuated air discharged from the pipe 31 can be adjusted, for example, by throttling. By adjusting the amount of evacuated air, the pressure level of the apparatus is adjusted to be such that the binding agent is discharged from the storage space 36 into the ground by pushing with pressure, that is, the adjusted pressure is adjusted to be greater than the pressure generated by the resistance of the soil at the binding agent discharge point 37.

The method according to the invention provides pillars of excellent quality, because pressurized air is not conveyed into the ground unnecessarily to interfere with the surrounding soil and the binding agent can be distributed evenly over the cross-section of the pillar, whereby a pillar of uniform quality and with a good bearing capacity is obtained.

In the foregoing, the application of the invention is described in connection with a pillar drill, but it is obvious that the invention can also be applied to different types of stabilization devices by means of which binding agent is conveyed and mixed into the ground.

The invention claimed is:

1. A method for evacuating transfer air contained in a binding agent from a mixture of pressurized air and binding agent when stabilizing earth masses by adding binding agent, in which method is used an apparatus comprising means for producing pressurized air, a binding agent container, a supply pipe for the mixture of pressurized air and binding agent, the apparatus including a mixing head for mixing the binding agent into the earth mass, and in which method the pressurized air used for transferring the binding agent is evacuated through a separate discharge pipe by the following measures before the pressurized air is conveyed into the earth mass:

1) the binding agent is conveyed into a storage space with a binding agent discharge opening into a ground; and
2) a pressure level in the apparatus is adjusted to be such that the pressure in the storage space exceeds a counter-pressure caused by the ground at the discharge opening, whereupon the binding agent discharges from the storage space via the discharge opening out into the ground and at least a part of the pressurized air discharges controllably from an upper part of the storage space into the discharge pipe, wherein water is sprayed into the supply pipe and a flow rate of the mixture of pressurized air, binding agent and water is accelerated momentarily by a Venturi-type nozzle, a so-called Laval nozzle, to disperse the water into a mist to which a powdery binding agent adheres, thus forming a sludge-like mass which is led to the storage space.

2. The method of claim 1, wherein the direction of flow of the supply pressurized air is reversed from a supply flow directed downwards in the upper part of the storage space in a tight curve to an upwards directed discharge flow, and an upwards directed flow rate is decreased to less than half of the downwards directed flow rate by using the cross-sectional area of the discharge pipe, which is at least twice as large as the cross-sectional area of the supply pipe.

3. The method of claim 1, wherein the evacuated pressurized air is washed with a cyclone scrubber located at the upper end of the discharge pipe, wherein the binding agent is separated from the air to be evacuated and from the centre of the upper flange of which air is evacuated controllably, thus adjusting the pressure level of the apparatus.

4. The method of claim 1, wherein the method is used for manufacturing pillars in the ground by deep stabilization.

5. The method of claim 1, wherein the direction of flow of the supply air is set into rotary motion with respect to a vertical axis in the storage space before reversing the flow upwards to intensify the separation of binding agent and water from the air by centrifugal force.

* * * * *